US011293276B2

(12) United States Patent
Searles et al.

(10) Patent No.: US 11,293,276 B2
(45) Date of Patent: Apr. 5, 2022

(54) MONITORING A FRACTURE IN A HYDROCARBON WELL

(71) Applicant: ExxonMobil Upstream Research Company, Spring, TX (US)

(72) Inventors: Kevin H. Searles, Kingwood, TX (US); Ted A. Long, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/899,695

(22) Filed: Jun. 12, 2020

(65) Prior Publication Data

US 2021/0017852 A1 Jan. 21, 2021

Related U.S. Application Data

(60) Provisional application No. 62/876,278, filed on Jul. 19, 2019.

(51) Int. Cl.
*E21B 47/06* (2012.01)
*E21B 47/09* (2012.01)

(52) U.S. Cl.
CPC ..... *E21B 47/06* (2013.01); *E21B 47/09* (2013.01)

(58) Field of Classification Search
CPC ..... E21B 47/06; E21B 47/09; E21B 47/13; E21B 47/26
See application file for complete search history.

(56) References Cited

U.S. PATENT DOCUMENTS

| | | | | |
|---|---|---|---|---|
| 6,408,943 | B1 * | 6/2002 | Schultz | E21B 47/01 166/285 |
| 8,269,648 | B2 * | 9/2012 | Benischek | E21B 47/125 340/855.8 |
| 2005/0055162 | A1 * | 3/2005 | Gao | G01V 1/22 702/2 |
| 2008/0106972 | A1 * | 5/2008 | Liang | E21B 47/12 367/25 |
| 2010/0242585 | A1 * | 9/2010 | Pratyush | E21B 21/00 73/152.04 |
| 2015/0285948 | A1 * | 10/2015 | Kamal | G01V 11/00 73/152.17 |

* cited by examiner

*Primary Examiner* — Christopher J Sebesta
(74) *Attorney, Agent, or Firm* — Leandro Arechederra, III

(57) ABSTRACT

Hydrocarbon wells that include interrogation devices positioned within a fracture and methods of monitoring at least one property of a fracture. The hydrocarbon wells include a wellbore that extends within a subsurface region and a fracture that extends from the wellbore. The hydrocarbon wells also include a plurality of interrogation devices entrained within a carrier fluid and positioned within the fracture and a downhole communication device positioned within the wellbore and proximal the fracture. The methods include flowing the interrogation devices into the fracture and conveying the excitation signal into the fracture. The methods also include receiving the excitation signal with the interrogation devices and generating a plurality of corresponding resultant signals with the interrogation devices. The methods further include receiving at least a subset of the corresponding resultant signals with a downhole communication device and determining at least one property of the fracture based upon the corresponding resultant signals.

25 Claims, 3 Drawing Sheets

MONITORING A FRACTURE IN A HYDROCARBON WELL

CROSS-REFERENCE TO RELATED APPLICATION

This application claims the benefit of U.S. Provisional Application 62/876,278 filed Jul. 19, 2019 entitled Monitoring a Fracture in a Hydrocarbon Well, the entirety of which is incorporated by reference herein.

FIELD OF THE DISCLOSURE

The present disclosure relates generally to hydrocarbon wells that include interrogation devices positioned within a fracture and/or to methods of monitoring at least one property of a fracture.

BACKGROUND OF THE DISCLOSURE

During formation and/or completion of hydrocarbon wells, fracture operations may be utilized to fracture a subsurface region within which the hydrocarbon well extends, such as to increase a fluid permeability of the subsurface region. While mechanisms for forming fractures within a subsurface region are well-established, the shape, size, and/or extent of the formed fractures generally is not known. Thus, there exists a need for hydrocarbon wells that include interrogation devices positioned within a fracture and/or for methods of monitoring at least one property of a fracture.

SUMMARY OF THE DISCLOSURE

Hydrocarbon wells that include interrogation devices positioned within a fracture and methods of monitoring at least one property of a fracture are disclosed herein. The hydrocarbon wells include a wellbore that extends within a subsurface region and a fracture that extends from the wellbore. The hydrocarbon wells also include a plurality of interrogation devices entrained within a carrier fluid and positioned within the fracture. The hydrocarbon wells further include a downhole communication device positioned within the wellbore and proximal the fracture. The plurality of interrogation devices is configured to generate a plurality of corresponding resultant signals responsive to receipt of an excitation signal.

The methods include flowing a plurality of interrogation devices within a carrier fluid and from the wellbore into the fracture. The methods also include conveying the excitation signal into the fracture. The methods further include receiving the excitation signal with the plurality of interrogation devices and, responsive to the receiving, generating a plurality of corresponding resultant signals with the plurality of interrogation devices. The methods also include receiving at least a subset of the plurality of corresponding resultant signals from at least a subset of the plurality of interrogation devices with a downhole communication device that is positioned within the wellbore. The methods further include determining at least one property of the fracture based, at least in part, upon the subset of the plurality of corresponding resultant signals.

DETAILED DESCRIPTION AND BEST MODE OF THE DISCLOSURE

Figure 1:
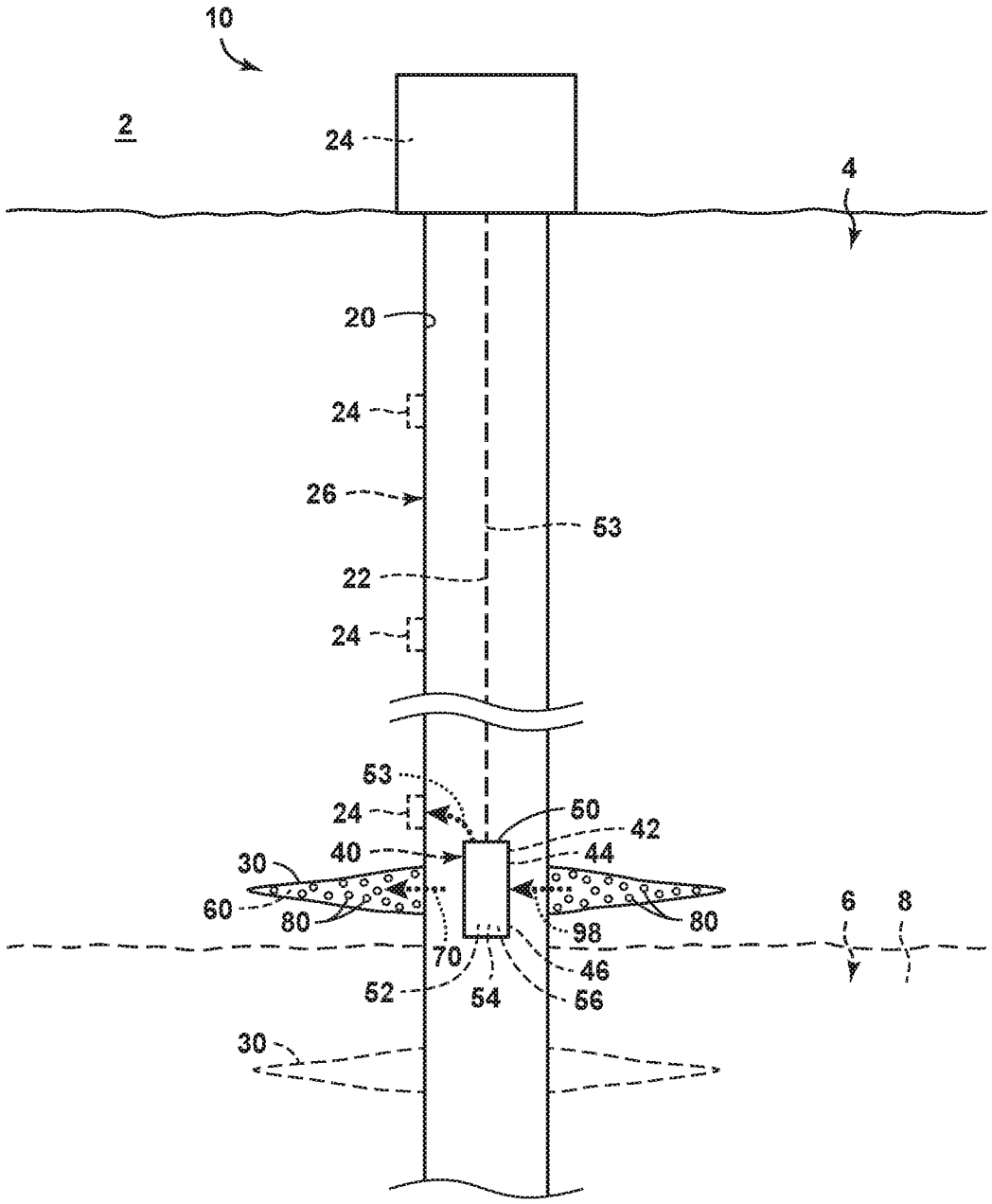
FIG. 1 is a schematic illustration of examples of a hydrocarbon well according to the present disclosure.
Figure 2:
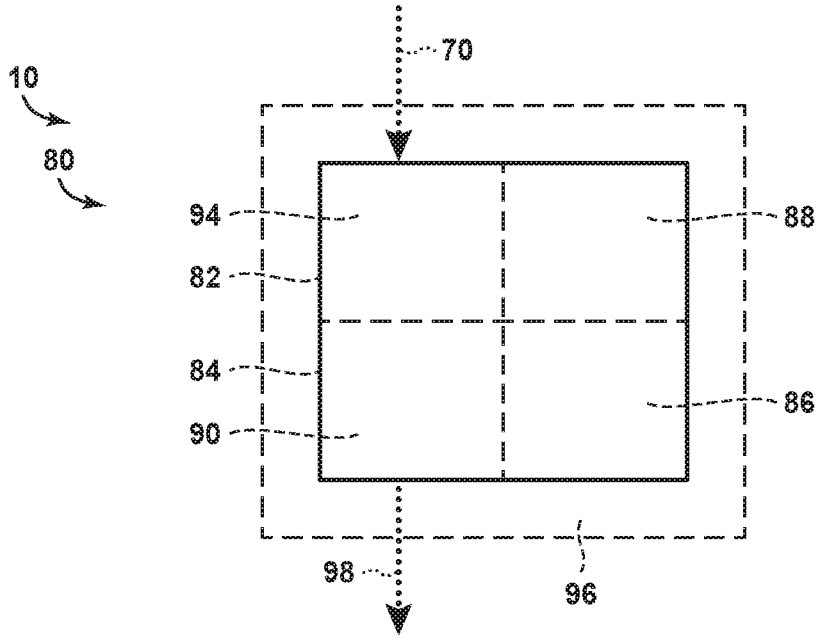
FIG. 2 is a schematic illustration of examples of an interrogation device that may be utilized with hydrocarbon wells and/or methods, according to the present disclosure.
Figure 3:
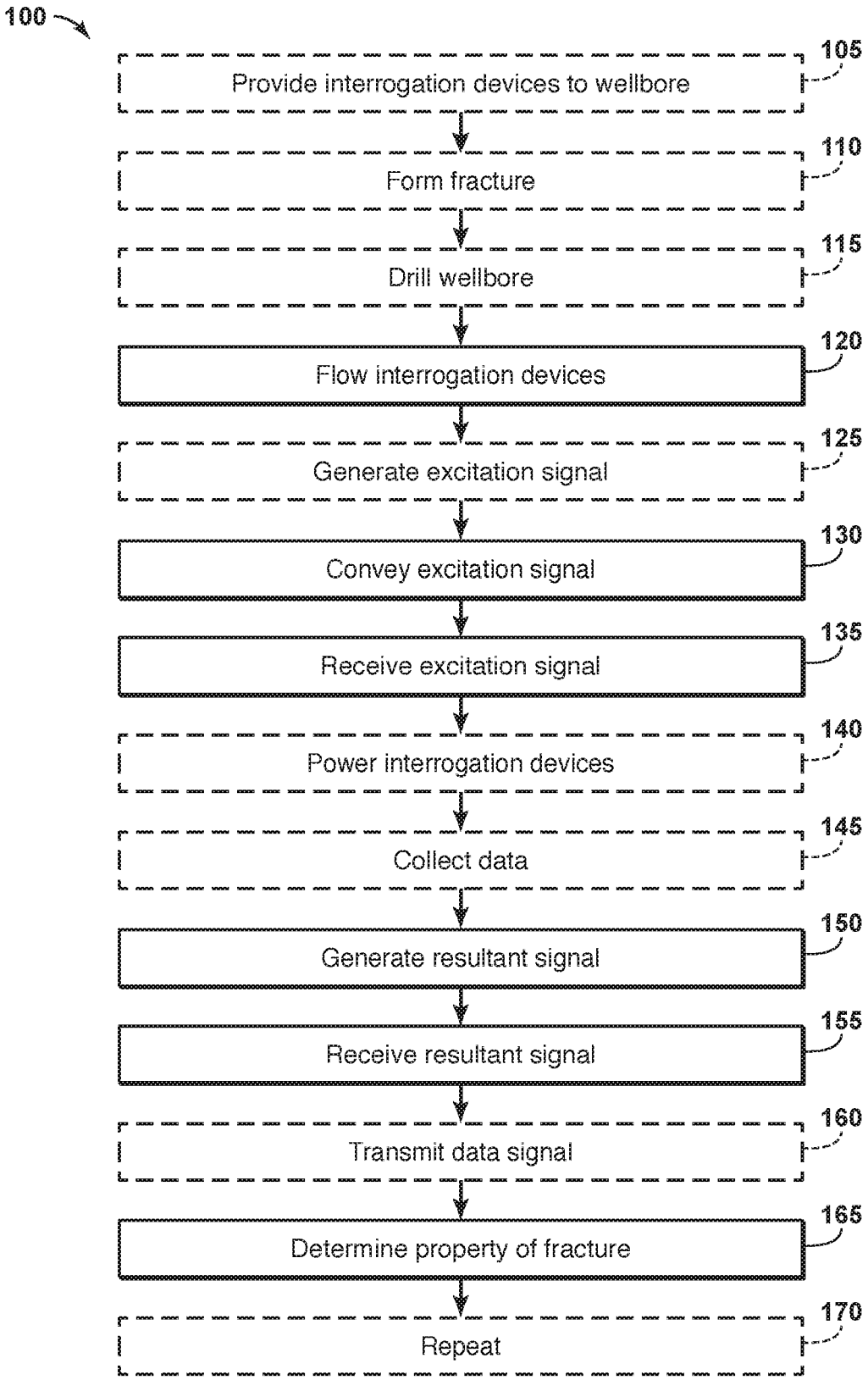
FIG. 3 is a flowchart depicting examples of methods of monitoring at least one property of a fracture that extends from a wellbore of a hydrocarbon well, according to the present disclosure.

FIGS. 1-3 provide examples of hydrocarbon wells 10, interrogation devices 80, and/or methods 100, according to the present disclosure. Elements that serve a similar, or at least substantially similar, purpose are labeled with like numbers in each of FIGS. 1-3, and these elements may not be discussed in detail herein with reference to each of FIGS. 1-3. Similarly, all elements may not be labeled in each of FIGS. 1-3, but reference numerals associated therewith may be utilized herein for consistency. Elements, components, and/or features that are discussed herein with reference to one or more of FIGS. 1-3 may be included in and/or utilized with any of FIGS. 1-3 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of a hydrocarbon well 10 according to the present disclosure, while FIG. 2 is a schematic illustration of examples of an interrogation device 80 that may be utilized with hydrocarbon wells 10 and/or methods 100, according to the present disclosure. As illustrated in FIG. 1, hydrocarbon wells 10 include a wellbore 20 that extends within a subsurface region 4. Wellbore 20 also may be referred to herein as extending between a surface region 2 and a subterranean formation 6 that extends within the subsurface region. Hydrocarbon wells 10 also include at least one fracture 30 that extends from wellbore 20 into and/or within the subsurface region. As illustrated schematically by the combination of solid and dashed lines in FIG. 1, hydrocarbon wells 10 may include a plurality of fractures 30. For simplicity's sake, the following discussion frequently will refer to a fracture 30, but it is within the scope of the present disclosure that this discussion may apply to more than one fracture 30, such as a plurality of fractures 30.

Hydrocarbon wells 10 further include a plurality of interrogation devices 80. Interrogation devices 80 may be entrained within a carrier fluid. Additionally or alternatively, at least a subset of interrogation devices 80 may be positioned within fracture 30 and/or within the plurality of fractures 30. Interrogation devices 80 may be configured to produce and/or generate a plurality of corresponding resultant signals 98 responsive to receipt of an excitation signal 70. Hydrocarbon wells 10 also include a downhole communication device 50. Downhole communication device 50 may be positioned within wellbore 20 and/or may be proximal fracture 30.

During operation of hydrocarbon wells 10, such as during the examples of methods 100, that are discussed in more detail herein, interrogation devices 80 may flow into fracture 30. Subsequently excitation signal 70 may be generated and/or conveyed into the fracture and received by interrogation devices 80. Responsive to receipt of the excitation signal, interrogation devices 80 may produce and/or generate the plurality of corresponding resultant signals 98, at least a subset of which may be received with and/or by downhole communication device 50. At least one property of fracture 30 then may be calculated, established, and/or determined based, at least in part, on the subset of the plurality of corresponding resultant signals 98 received by the downhole communication device. As such, and as discussed in more detail herein with reference to methods 100 of FIG. 3, hydrocarbon wells 10 according to the present disclosure may permit and/or facilitate actual, direct, and/or in situ determination of the at least one property of the fracture, examples of which are disclosed herein with reference to methods 100.

In some examples, downhole communication device 50 may include a communication device receiver 54. The communication device receiver, when present, may be configured to receive resultant signals 98, or a subset of the plurality of corresponding resultant signals 98, from interrogation devices 80.

In some examples, downhole communication device 50 may include a communication device excitation signal transmitter 56. The communication device excitation signal transmitter, when present, may be configured to generate excitation signal 70 and/or to provide excitation signal 70 to interrogation devices 80. In these examples, excitation signal 70 may include and/or be a radio frequency excitation signal. The radio frequency excitation signal may have and/or may define any suitable signal frequency. Examples of the signal frequency include signal frequencies of at least 10 kilohertz (KHz), at least 20 KHz, at least 30 KHz, at least 40 KHz, at least 50 KHz, at least 75 KHz, at least 100 KHz, at least 250 KHz, at least 500 KHz, at least 1 megahertz (MHz), at least 50 MHz, at least 100 MHz, at least 250 MHz, at least 500 MHz, at least 1 GHz, at least 2 GHz, at most 5 GHz, at most 4 GHz, at most 3 GHz, at most 2.5 GHz, at most 2 GHz, at most 1.5 GHz, at most 1 GHz, at most 500 MHz, at most 100 MHz, at most 500 KHz, and/or at most 100 KHz.

In some examples, downhole communication device 50 may form a portion of a downhole assembly 40. Downhole assembly 40, when present, additionally may include one or more of a perforation gun 42, a downhole pressure pulse generator 44, and/or a downhole electric field generator 46. Perforation gun 42, when present, may be configured to generate one or more perforations within a casing 26 that may line wellbore 20 thereby permitting and/or facilitating formation of fractures 30. Downhole pressure pulse generator 44, when present, may be configured to generate excitation signal 70 in the form of a pressure pulse excitation signal within carrier fluid 60. Downhole electric field generator 46, when present, may be configured to generate excitation signal 70 in the form of an electric field excitation signal.

As illustrated in dashed lines in FIG. 1, downhole communication device 50 may include a communication device data transmitter 52. Communication device data transmitter 52, when present, may be configured to transmit a data signal 53 to surface region 2. Data signal 53 may include information regarding, may be based upon, and/or may be representative of the at least one property of the fracture.

The data signal may be transmitted to the surface region in any suitable manner. As an example, the hydrocarbon well may include an electrical conductor 22 that may extend between the downhole communication device and the surface region. In this example, the downhole communication device may be configured to transmit the data signal via the electrical conductor. As another example, an optical fiber may extend between the downhole communication device and the surface region. In this example, the hydrocarbon well also may include one or more optical encoders and/or optical decoders that may provide an optical signal to the optical fiber and/or that may receive the optical signal from the optical fiber.

As another example, communication device data transmitter 52 may include and/or be a wireless communication device data transmitter configured to wirelessly transmit the data signal to the surface region. In this example, hydrocarbon well 10 may include a downhole wireless network 24 that may extend within the wellbore and/or that may be configured to convey the data signal between the downhole communication device and the surface region. Examples of the wirelessly transmitted data signal include an electromagnetic data signal, a radio frequency data signal, and/or an acoustic data signal that may be conveyed along and/or within wellbore 20, casing 26, and/or carrier fluid 60.

Turning to FIG. 2, interrogation devices 80 may include any suitable structure that may be positioned within the fracture, that may be entrained within the carrier fluid, and/or that may generate the corresponding resultant signals. In addition, interrogation devices 80 may generate corresponding resultant signals 98 in any suitable manner.

As an example, interrogation devices 80 may include a plurality of passive interrogation devices 82. Passive interrogation devices 82 may be configured to passively interact with excitation signal 70 and/or to passively generate resultant signal 98. An example of passive interrogation devices 82 includes a plurality of radio frequency identification (RFID) interrogation devices. RFID interrogation devices may receive excitation signal 70 and may passively interact with, or modify, the excitation signal to generate the resultant signal.

As another example, interrogation devices 80 may include a plurality of active interrogation devices 84. Active interrogation devices 84 may be configured to actively generate resultant signal 98. As an example, active interrogation devices 84 may include at least one sensor 86. Sensor 86 may be configured to collect data related to the at least one property of the fracture. Examples of the data include an absolute location of each interrogation device relative to the downhole communication device, a relative location of each interrogation device relative to at least one other interrogation device, a pressure acting on each interrogation device, and/or a temperature of each interrogation device.

Active interrogation devices 84 additionally or alternatively may include energy harvesting structures 88. Energy harvesting structures 88 may be configured to generate electrical energy responsive to receipt of excitation signal 70 and/or responsive to fluid contact with carrier fluid 60, such as to power one or more other components of the active interrogation device.

Examples of energy harvesting structures 88 include an electromagnetic energy harvesting structure, such as an RFID structure, configured to generate electrical energy responsive to receipt of an electromagnetic excitation signal, a pressure energy harvesting structure, such as a piezoelectric element, configured to generate electrical energy responsive to receipt of a pressure pulse excitation signal, and/or an electric field energy harvesting structure, such as an inductive coil, configured to generate electrical energy responsive to receipt of an electric field excitation signal. Additional or alternative examples of energy harvesting structures 88 include structures that react with carrier fluid 60 and/or that otherwise generate electrical energy responsive to fluid contact with the carrier fluid. As an example, energy harvesting structures 88 may form a battery via contact with, or utilizing, the carrier fluid. As another example, and as discussed in more detail herein, the carrier fluid may include and/or be an electrically conductive carrier fluid, and energy harvesting structures 88 may receive the electric current from the electrically conductive carrier fluid.

Interrogation device 80 additionally or alternatively may include one or more interrogation device transmitters 90. Interrogation device transmitters 90 may be configured to generate resultant signals 98, such as may be responsive to receipt of excitation signal 70. Interrogation devices 80 additionally or alternatively may include interrogation device receivers 94. Interrogation device receivers 94 may be configured to receive a corresponding resultant signal 70 from another interrogation device in the plurality of interrogation devices, such as to permit and/or to facilitate device-to-device communication among two or more interrogation devices 80.

As illustrated in dashed lines in FIG. 2, interrogation devices 80 may include an encapsulating material 96. Such interrogation devices may be referred to herein as encapsulated interrogation devices. An example of encapsulating material 96 includes a proppant material. In such a configuration, interrogation devices 80 additionally may be configured to function as, or may be, a proppant within the fractures of the hydrocarbon well and may be spherical, or at least substantially spherical, in shape.

FIG. 3 is a flowchart depicting examples of methods 100 of monitoring at least one property of a fracture that extends from a wellbore of a hydrocarbon well and within a subsurface region, according to the present disclosure. Methods 100 may include providing a plurality of interrogation devices to the wellbore at 105, forming a fracture at 110, and/or drilling the wellbore at 115. Methods 100 include flowing the plurality of interrogation devices at 120 and may include generating an excitation signal at 125. Methods 100 include conveying the excitation signal at 130 and receiving the excitation signal at 135. Methods 100 also may include powering the plurality of interrogation devices at 140 and/or collecting data at 145, and methods 100 also may include generating a plurality of corresponding resultant signals at 150 and receiving at least a subset of the plurality of corresponding resultant signals at 155. Methods 100 further may include transmitting a data signal at 160, determining a property of the fracture at 165, and repeating at least a portion of the methods at 170.

Providing the plurality of interrogation devices to the wellbore at 105 may include providing the plurality of interrogation devices to the wellbore and/or positioning the plurality of interrogation devices within the wellbore in any suitable manner. As an example, the providing at 105 may include injecting, or flowing, the plurality of interrogation devices into the wellbore from a surface region and/or within a carrier fluid, such as carrier fluid 60 of FIG. 1. Examples of the plurality of interrogation devices are disclosed herein with reference to interrogation devices 80 of FIGS. 1-2.

The providing at 105 may include selectively providing the plurality of interrogation devices to the wellbore based upon and/or responsive to a supply criteria. As an example, the selectively providing may include selectively providing at a predetermined time. As another example, the selectively providing may include repeated and selectively providing on a predetermined schedule, or time interval. As additional examples, the selectively providing may include selectively providing based upon a fluid type of the carrier fluid, based upon a flow rate of the carrier fluid, and/or based upon an operational sequence for the hydrocarbon well. Additionally or alternatively, the providing at 105 may include continuously providing the plurality of interrogation devices to the wellbore, at least during a predetermined providing time interval.

In these examples, methods 100 may include forming the fracture at 110, such as via flow of the carrier fluid into the subsurface region and/or via pressurization of the subsurface region with the carrier fluid. In these examples, methods 100 also may include propping the fracture with, via, and/or utilizing the plurality of interrogation devices. Stated another way, the plurality of interrogation devices may function both as a proppant and as a mechanism via which methods 100 may determine the at least one property of the fracture.

The forming at 110 may be accomplished in any suitable manner and/or as part of any suitable operation of and/or within the hydrocarbon well. As an example, the carrier fluid may include and/or be a fracture fluid that may be configured to fracture the subsurface region, such as during a fracture stimulation operation and/or during completion of the hydrocarbon well. In this example, methods 100 may permit and/or facilitate monitoring of the at least one property of the fracture during the fracture stimulation operation.

As another example, the carrier fluid may include and/or be a cuttings re-injection fluid that includes drill cuttings that may be injected as part of a cuttings injection operation. In this example, the forming at 110 may include forming the fracture via flow of the cuttings re-injection fluid into and/or within the subsurface region, and methods 100 may permit and/or facilitate monitoring of the at least one property of the fracture during the cuttings injection operation.

As yet another example, the carrier fluid may include and/or be water, such as produced water, that may be injected as part of a water re-injection operation. In this example, the forming at 110 may include forming the fracture via flow of the produced water into and/or within the subsurface region, and methods 100 may permit and/or facilitate monitoring of the at least one property of the fracture during the water re-injection operation.

Drilling the wellbore at 115 may include utilizing a drill bit to drill the wellbore and/or to extend a length of the wellbore, such as during a drilling operation. As an example, the drilling at 115 may be performed prior to a remainder of the steps of methods 100, such as to establish and/or define the wellbore. As another example, the drilling at 115 may be performed at least partially concurrently with one or more steps of methods 100. As a more specific example, and during the drilling at 115, the carrier fluid may include a drilling mud, and the drilling at 115 may include drilling with, via, and/or utilizing the drilling mud. In this example, methods 100 may be utilized to monitor for fracture formation within the subsurface region and/or to monitor for lost returns due to fracture formation during the drilling operation.

Flowing the plurality of interrogation devices at 120 may include flowing the plurality of interrogation devices within the carrier fluid, from the wellbore, and/or into the fracture. This may include flowing the plurality of interrogation devices from the surface region, within the wellbore, and/or to the fracture. As discussed, the plurality of interrogation devices also may be, or may function as, a proppant for the fracture. With this in mind, the flowing at 120 further may include propping the fracture with, via, and/or utilizing the plurality of interrogation devices.

Generating the excitation signal at 125 may include generating the excitation signal in any suitable manner. As an example, the generating at 125 may include generating the excitation signal with, via, and/or utilizing a downhole communication device, such as downhole communication device 50 of FIG. 1. As another example, the generating at 125 may include generating the excitation signal with, via, and/or utilizing a downhole pressure pulse generator, such as downhole pressure pulse generator 44 of FIG. 1. As yet another example, the generating at 125 may include generating with, via, and/or utilizing a downhole electric field generator, such as downhole electric field generator 46 of FIG. 1. Examples of the excitation signal are disclosed herein with reference to excitation signal 70 of FIG. 1.

Conveying the excitation signal at 130 may include conveying the excitation signal into the fracture. This may include conveying the excitation signal within carrier fluid, conveying the excitation signal via the carrier fluid, and/or conveying the excitation signal through the carrier fluid.

Receiving the excitation signal at 135 may include receiving the excitation signal with the plurality of interrogation devices. This may include receiving the excitation signal from the carrier fluid, receiving the excitation signal via the carrier fluid, receiving the excitation signal from the downhole communication device, and/or receiving the excitation signal from another interrogation device in the plurality of interrogation devices.

Powering the plurality of interrogation devices at 140 may include powering the plurality of interrogation devices in any suitable manner. As an example, the powering at 140 may include powering with, via, and/or utilizing an energy storage device of each interrogation device of the plurality of interrogation devices. As another example, the powering at 140 may include powering with, via, and/or utilizing the excitation signal. In this example, the powering at 140 further may include powering with, via, and/or utilizing an energy harvesting structure of each interrogation device of the plurality of interrogation devices. Examples of the energy harvesting structure are disclosed herein with reference to energy harvesting structure 88 of FIG. 2.

Collecting data at 145 may include collecting data with, via, and/or utilizing the plurality of interrogation devices and/or with, via, and/or utilizing a sensor of each interrogation device of the plurality of interrogation devices. Examples of the sensor are disclosed herein with reference to sensor 86 of FIG. 2. The data may include and/or be any suitable data that may be collected by the plurality of interrogation devices. As examples, the data may include spatial information regarding each interrogation device of the plurality of interrogation devices, scalar information regarding each interrogation device, absolute distance information regarding a distance between each interrogation device and the downhole communication device, relative distance information regarding a distance between each interrogation device and at least one other interrogation device of the plurality of interrogation devices, pressure information regarding a pressure exerted upon each interrogation device, and/or temperature information regarding a temperature of each interrogation device.

Generating the plurality of corresponding resultant signals at 150 may include generating the plurality of corresponding resultant signals with the plurality of interrogation devices and may be responsive to the receiving at 135. Stated another way, each interrogation device of the plurality of interrogation devices that receives the excitation signal during the receiving at 135 may, responsive to receipt of the interrogation signal, generate a corresponding resultant signal. Examples of the resultant signal and/or of mechanisms via which the plurality of interrogation devices perform the generating at 150 are discussed in more detail herein.

Receiving at least the subset of the plurality of corresponding resultant signals at 155 may include receiving the subset of the plurality of corresponding resultant signals from at least a subset of the plurality of interrogation devices. Additionally or alternatively, the receiving at 155 may include receiving with, via, and/or utilizing a downhole communication device that may be positioned with the wellbore, such as downhole communication device 50 of FIG. 1.

It is within the scope of the present disclosure that the subset of the plurality of interrogation devices may include interrogation devices that are within a threshold distance range of the downhole communication device. Examples of the threshold distance range include distances of at least 0.01 meters, at least 0.05 meters, at least 0.1 meters, at least 0.25 meters, at least 0.5 meters, at least 0.75 meters, at least 1 meter, at least 2 meters, at most 10 meters, at most 8 meters, at most 6 meters, at most 5 meters, at most 4 meters, at most 3 meters, at most 2.5 meters, at most 2 meters, at most 1.5 meters, and/or at most 1 meter.

Transmitting the data signal at 160 may include transmitting any suitable data signal, which may be based upon the plurality of resultant signals, to the surface region. The transmitting at 160 may be subsequent to and/or responsive to the receiving at 155. Stated another way, subsequent to receipt of the subset of the plurality of corresponding resultant signals during the receiving at 155, methods 100 may include performing the transmitting at 160.

The transmitting at 160 may be accomplished in any suitable manner. As an example, the transmitting at 160 may include transmitting a wired data signal. As a more specific example, an electrical conductor, such as electrical conductor 22 of FIG. 1, may extend within the wellbore and/or between the downhole communication device and the surface region; and the transmitting at 160 may include transmitting with, via, and/or utilizing the electrical conductor. As another example, the transmitting at 160 may include wirelessly transmitting the data signal. As more specific examples, the transmitting at 160 may include transmitting via an acoustic signal that is propagated within the wellbore, transmitting via an electromagnetic signal that is propagated within the wellbore, and/or transmitting via a downhole wireless network, such as downhole wireless network 24 of FIG. 1, that extends within the wellbore.

Determining the property of the fracture at 165 may include calculating, establishing, estimating, and/or otherwise defining at least one property of the fracture based, at least in part, on the subset of the plurality of corresponding resultant signals received during the receiving at 155. Examples of the at least one property of the fracture include a one-dimensional measure of fracture size as a function of distance from the wellbore, a two-dimensional measure of fracture size as a function of distance from the wellbore, a fracture width, a fracture height, a fracture length, and/or a three-dimensional measure of fracture geometry within the subsurface region.

In a specific example, the subset of the plurality of corresponding resultant signals may include distance information regarding a distance between the downhole communication device and each interrogation device of the subset of the plurality of interrogation devices. In this example, the determining at 165 may include determining the at least one property of the fracture based, at least in part, on the distance information. Additionally or alternatively in this example, the at least one property of the fracture may include fracture size as a function of distance from the downhole communication device.

In another specific example, the subset of the plurality of corresponding resultant signals may include absolute spatial information regarding a location of each interrogation device of the subset of the plurality of interrogation devices relative to the downhole communication device. In this example, the determining at 165 may include determining the at least one property of the fracture based, at least in part, on the absolute spatial information. Additionally or alternatively in this example, the at least one property of the fracture may include fracture size as a function of location within the subsurface region.

As yet another more specific example, the subset of the plurality of corresponding resultant signals may include relative spatial information regarding a location of each interrogation device of the subset of the plurality of interrogation devices relative to at least one other interrogation device in the plurality of interrogation devices. In this example, the determining at 165 may include determining the at least one property of the fracture based, at least in part, on the relative spatial information. Additionally or alternatively in this example, the at least one property of the fracture may include fracture size as a function of location within the subsurface region.

In another more specific example, a combination of the above determining steps may be performed. As an example, the distance between the downhole communication device and each interrogation device of the subset of the plurality of interrogation devices may be determined, such as via an elapsed time between the generating at 125 and the receiving at 135. In addition, relative spatial information regarding a location of each interrogation device of the subset of the plurality of interrogation devices relative to at least one other interrogation device in the plurality of interrogation devices also may be determined, such as via interrogation device-to-interrogation device communication. The combination of these two pieces of information then may be utilized to generate a 2-dimensional or 3-dimensional map of particle location within the subsurface region, and this map of particle location then may be utilized to determine, to establish, and/or to infer fracture geometry and/or morphology within the subsurface region.

It is within the scope of the present disclosure that the determining at 165 additionally or alternatively may include determining one or more other properties of the subsurface region and/or of the fracture. As an example, the subset of the plurality of corresponding resultant signals may include temperature information regarding a temperature proximal each interrogation device of the subset of the plurality of interrogation devices. In this example, the at least one property of the fracture may include a temperature distribution within the fracture.

As another example, the subset of the plurality of corresponding resultant signals may include pressure information regarding a pressure proximal and/or acting upon each interrogation device of the subset of the plurality of interrogation devices. In this example, the at least one property of the fracture may include a pressure distribution within the fracture.

Repeating at least the portion of the methods at 170 may include repeating any suitable portion and/or portions of methods 100 in any suitable order and/or for any suitable purpose. As an example, the repeating at 170 may include repeatedly performing the conveying at 130, the generating at 150, the receiving at 155, and the determining at 165 during a monitoring timeframe. Such methods may permit and/or facilitate determination of the at least one property of the fracture as a function of time. This may, for example, permit and/or facilitate determination of flow kinetics of the plurality of interrogation devices into the fracture and/or determination of growth kinetics of the fracture.

As discussed herein with reference to the forming at 110, the carrier fluid may include and/or be a fracture fluid utilized during a fracture stimulation operation. In this example, the repeating at 170 may include repeating to measure and/or monitor fracture growth, fracture size, fracture volume, fracture extent, and/or fracture shape during the fracture stimulation operation.

As also discussed herein with reference to the forming at 110, the carrier fluid may include and/or be a cuttings re-injection fluid that includes drill cuttings utilized during a cuttings re-injection operation. In this example, the repeating at 170 may include repeating to measure and/or monitor fracture growth during the cuttings re-injection operation.

As also discussed herein with reference to the forming at 110, the carrier fluid may include and/or be produced water utilized during a water re-injection operation. In this example, the repeating at 170 may include repeating to measure and/or monitor fracture growth during the water re-injection operation.

As discussed herein with reference to the drilling at 115, the carrier fluid may include a drilling mud utilized during a drilling operation. In this example, the repeating at 170 may include repeating to monitor for, or to detect, lost returns due to fracture formation during the drilling operation.

Regardless of the nature of the carrier fluid, methods 100 may be utilized to form a plurality of fractures, such as during a single instance of the forming at 110 and/or by repeating the forming at 110. Additionally or alternatively, methods 100 may be utilized to monitor geometry and/or growth of the plurality of factures, such as by repeating the flowing at 120, the conveying at 130, the receiving at 135, the generating at 150, the receiving at 155, and/or the determining at 165. It is within the scope of the present disclosure that hydrocarbon wells 10 and/or methods 100 may include and/or utilize a significant number of variants and/or variations. More specific but still illustrative, non-exclusive examples of these variants and/or variations of hydrocarbon wells 10 and/or of methods 100 are disclosed below. It is within the scope of the present disclosure that any structure, function, and/or step of any of these variants and/or variations may be utilized with any hydrocarbon well 10 and/or method 100, according to the present disclosure.

In a first example, the plurality of interrogation devices may include and/or be a plurality of passive interrogation devices, such as a plurality of radio frequency identification (RFID) interrogation devices. In this example, the generating at 125 may include generating the excitation signal with the downhole communication device and/or the receiving at 135 may include receiving the excitation signal from the downhole communication device. In addition, the generating at 150 may include modifying the excitation signal to generate the plurality of corresponding resultant signals. The modifying may include resonating the plurality of interrogation devices at a frequency of the excitation signal to disrupt the excitation signal and/or to generate the plurality of corresponding resultant signals.

In a second example, the plurality of interrogation devices may include and/or be a plurality of active interrogation devices. In this example, methods 100 may include the powering at 140; and responsive to the powering at 140, methods 100 may include the collecting at 145. Stated another way, the plurality of active interrogation devices may be powered with, via, and/or utilizing the excitation signal, such as is disclosed herein with reference to the powering at 140. In addition, and responsive to receipt of power from the excitation signal, the plurality of active interrogation devices may collect data, such as is disclosed herein with reference to the collecting at 145. In this example, the generating at 150 may include generating the plurality of corresponding resultant signals based, at least in part, on the data collected during the collecting at 145.

It is within the scope of the present disclosure that each interrogation device in the plurality of interrogation device may include and/or define a unique identifier. In such a configuration, the generating at 150 additionally or alternatively may include generating the plurality of corresponding resultant signals based, at least in part, on the unique identifier. Stated another way, each interrogation device of the plurality of interrogation devices may generate a corresponding resultant signal that includes a corresponding unique identifier and/or may transmit the corresponding unique identifier to the downhole communication device. Such a configuration may permit and/or facilitate identification of individual interrogation devices of the plurality of interrogation devices and/or association of data transmitted by a given interrogation device with the given interrogation device.

In some implementations of this second example, the receiving at 155 may include receiving the subset of the plurality of corresponding resultant signals directly from the subset of the plurality of interrogation devices. Stated another way, the conveying at 130 may include directly conveying each corresponding resultant signal from a corresponding interrogation device to the downhole communication device.

In other implementations of this second example, the subset of the plurality of corresponding resultant signals may be a first subset of the plurality of corresponding resultant signals, and the subset of the plurality of interrogation devices may be a first subset of the plurality of interrogation devices. In these implementations, methods 100 further may include receiving a second subset of the plurality of corresponding resultant signals with the first subset of the plurality of interrogation devices. The second subset of the plurality of corresponding resultant signals may be received from a second subset of the plurality of interrogation devices, and the first subset of the plurality of corresponding resultant signals may be based, at least in part, on the second subset of the plurality of corresponding resultant signals. Stated another way, the second subset of the plurality of interrogation devices may communicate to, or with, the first subset of the plurality of interrogation devices; and information conveyed from the first subset of the plurality of interrogation devices to the downhole communication device may include information conveyed from the second subset of the plurality of interrogation devices to the first subset of the plurality of interrogation devices. Stated yet another way, methods 100 may include forming and/or utilizing a network of interrogation devices that may be configured for interrogation device-to-interrogation device communication. Such a configuration may permit and/or facilitate downhole communication over larger distances than otherwise may be feasible and/or may permit and/or facilitate determination of relative location and/or spatial information among the interrogation devices.

In one variation of the second example, the excitation signal, which may be conveyed during the conveying at 130 and/or received during the receiving at 135, may include and/or be a radio frequency excitation signal. In this variation, the powering at 140 may include powering with, via, and/or utilizing the radio frequency excitation signal, which may be generated during the generating at 125 and/or by the downhole communication device. Also in this variation, the plurality of interrogation devices may include a plurality of radio frequency identification (RFID) interrogation devices configured to generate a plurality of corresponding RFID power outputs responsive to receipt of the radio frequency excitation signal, and the RFID power outputs may be utilized to power the interrogation devices.

In another variation of the second example, the excitation signal, which may be conveyed during the conveying at 130 and/or received during the receiving at 135, may include and/or be a pressure pulse within the carrier fluid. In this variation, the powering at 140 may include powering with, via, and/or utilizing the pressure pulse. The pressure pulse may be generated during the generating at 125, such as utilizing the downhole communication device, a perforation gun attached to a downhole assembly that includes the downhole communication device, a downhole pressure pulse generator positioned within the wellbore, and/or an uphole pressure pulse generator positioned in a surface region.

Also in this variation, the powering at 140 may include powering with, via, and/or utilizing the pressure pulse. As an example, the plurality of interrogation devices may include a plurality of piezoelectric interrogation devices configured to generate a plurality of corresponding piezoelectric power outputs responsive to receipt of the pressure pulse, and the piezoelectric power outputs may be utilized to power the interrogation devices.

In yet another variation of the second example, the excitation signal, which may be conveyed during the conveying at 130 and/or received during the receiving at 135, may include and/or be an electric field conveyed within the carrier fluid. In this variation, the powering at 140 may include powering with, via, and/or utilizing the electric field, which may be generated during the generating at 125. To facilitate the conveying at 130, the carrier fluid may include an electrically conductive carrier fluid, an ionic carrier fluid, and/or an electrolytic carrier fluid that may be configured to convey the excitation signal. Also in this variation, the plurality of interrogation devices may include a plurality of energy harvesting interrogation devices configured to generate a plurality of corresponding harvested power outputs responsive to receipt of the electric field, and the harvested power outputs may be utilized to power the interrogation devices.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or"

clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of monitoring at least one property of a fracture that extends from a wellbore of a hydrocarbon well and within a subsurface region, the method comprising:

injecting a plurality of interrogation devices within a carrier fluid, from the wellbore, and into the fracture and thereby expanding the fracture;

generating an electrical excitation signal conveyable within the carrier fluid, and conveying the excitation signal into the fracture via the carrier fluid;

receiving the excitation signal with an energy harvesting structure included in each interrogation device;

responsive to the receiving, generating a plurality of corresponding resultant signals with the plurality of interrogation devices;

receiving at least a subset of the plurality of corresponding resultant signals from at least a subset of the plurality of interrogation devices with a downhole communication device that is positioned within the wellbore; and determining the at least one property of the fracture based, at least in part, on the subset of the plurality of corresponding resultant signals.

2. The method of claim 1, wherein the subset of the plurality of corresponding resultant signals includes distance information regarding a distance between the downhole communication device and each interrogation device of the subset of the plurality of interrogation devices, and further wherein the at least one property of the fracture is based, at least in part, on the distance information.

3. The method of claim 2, wherein the at least one property of the fracture includes fracture size as a function of distance from the downhole communication device.

4. The method of claim 1, wherein the subset of the plurality of corresponding resultant signals includes absolute spatial information regarding a location of each interrogation device of the subset of the plurality of interrogation devices relative to the downhole communication device, and further wherein the at least one property of the fracture is based, at least in part, on the absolute spatial information.

5. The method of claim 4, wherein the at least one property of the fracture includes fracture size as a function of location within the subsurface region.

6. The method of claim 1, wherein the subset of the plurality of corresponding resultant signals includes relative spatial information regarding a location of each interrogation device of the subset of the plurality of interrogation devices relative to at least one other interrogation device in the plurality of interrogation devices, and further wherein the at least one property of the fracture is based, at least in part, on the relative spatial information.

7. The method of claim 6, wherein the at least one property of the fracture includes fracture size as a function of location within the subsurface region.

8. The method of claim 1, wherein the subset of the plurality of corresponding resultant signals includes temperature information regarding a temperature proximal each interrogation device of the subset of the plurality of interrogation devices, and further wherein the at least one property of the fracture includes a temperature distribution within the fracture.

9. The method of claim 1, wherein the subset of the plurality of corresponding resultant signals includes pressure information regarding a pressure proximal each interrogation device of the subset of the plurality of interrogation devices, and further wherein the at least one property of the fracture includes a pressure distribution within the fracture.

10. The method of claim 1, wherein determining the at least one property of the fracture comprises at least one of:

(i) determining flow kinetics of the plurality of interrogation devices into the fracture; and (ii) determining growth kinetics of the fracture.

11. The method of claim 1, wherein the plurality of interrogation devices includes a plurality of radio frequency identification (RFID) interrogation devices, and further wherein:

(i) the receiving the excitation signal includes receiving the excitation signal from the downhole communication device; and (ii) the generating the plurality of corresponding resultant signals includes modifying the excitation signal to generate the plurality of corresponding resultant signals.

12. The method of claim 1, wherein the method further includes:

generating electrical energy with the energy harvesting structure of each interrogation device responsive to receipt of the excitation signal; and powering the plurality of interrogation devices with the electrical energy generated from the excitation signal, and further wherein, responsive to the powering, the method further includes collecting data with the plurality of interrogation devices.

13. The method of claim 12, wherein the data includes at least one of:

(i) spatial information regarding each interrogation device in the plurality of interrogation devices;

(ii) scalar information regarding each interrogation device in the plurality of interrogation devices;

(iii) absolute distance information regarding a distance between each interrogation device in the plurality of interrogation devices and the downhole communication device;

(iv) relative distance information regarding a distance between each interrogation device in the plurality of interrogation devices and at least one other interrogation device in the plurality of interrogation devices;

(v) pressure information regarding a pressure exerted upon each interrogation device in the plurality of interrogation devices; and (vi) temperature information regarding a temperature of each interrogation device in the plurality of interrogation devices.

14. The method of claim 12, wherein the generating the plurality of corresponding resultant signals includes generating the plurality of corresponding resultant signals based, at least in part, on the data.

15. The method of claim 12, wherein the generating the plurality of corresponding resultant signals includes generating the plurality of corresponding resultant signals based, at least in part, on a unique identifier of each interrogation device in the plurality of interrogation devices.

16. The method of claim 12, wherein the excitation signal includes an electric field conveyed within the carrier fluid, and further wherein the powering includes powering utilizing the electric field.

17. The method of claim 1, wherein, subsequent to the receiving at least the subset of the plurality of corresponding resultant signals, the method further includes transmitting a data signal, which is based upon the plurality of corresponding resultant signals, to a surface region.

18. The method of claim 1, wherein the determining of the at least one property of the fracture occurs during the creation of the fracture and/or after its completion.

19. The method of claim 1, wherein the carrier fluid comprises a fracture fluid.

20. The method of claim 19, wherein the fracture fluid comprises at least one proppant to maintain the fracture.

21. The method of claim 20, wherein the proppant comprises the interrogation devices encapsulated by an encapsulating material.

22. The method of claim 1, wherein the interrogation devices consist essentially of radio frequency identification (RFID) interrogation devices.

23. A hydrocarbon well, comprising:

a wellbore that extends within a subsurface region;

a fracture extending from the wellbore within the subsurface region;

a downhole communication device positioned within the wellbore proximal the fracture, the downhole communication device being operable to generate an electrical excitation signal conveyable within a carrier fluid injected into the fracture; and a plurality of interrogation devices entrained within the carrier fluid, positioned within the fracture, each interrogation device including an energy harvester operable to receive the excitation signal via the carrier fluid and generate electrical energy that powers the generation of a plurality of corresponding resultant signals responsive to receipt of the excitation signal.

24. The hydrocarbon well of claim 23, wherein the plurality of interrogation devices includes a plurality of passive interrogation devices.

25. A method of monitoring a drilling operation for a wellbore of a hydrocarbon well, the method comprising:

drilling a portion of a wellbore with a drill bit arranged at a distal end of a drill string;

flowing a drilling mud into the wellbore via the drill string and the drill bit, the drilling mud including a plurality of interrogation devices suspended therein, and each interrogation device including an energy harvesting structure;

generating an electrical excitation signal conveyable within the drilling fluid, and conveying the excitation signal through the drilling fluid during drilling operations;

receiving the excitation signal with the energy harvesting structure included in each interrogation device;

responsive to the receiving, generating a plurality of corresponding resultant signals with the plurality of interrogation devices;

receiving at least a subset of the plurality of corresponding resultant signals from at least a subset of the plurality of interrogation devices with a downhole communication device that is positioned within the wellbore; and determining whether a fracture has formed in the wellbore based, at least in part, on the subset of the plurality of corresponding resultant signals.

* * * * *